US006941958B1

(12) United States Patent
Sobek et al.

(10) Patent No.: US 6,941,958 B1
(45) Date of Patent: Sep. 13, 2005

(54) UMBRELLA DEVICE

(75) Inventors: Werner Sobek, Stuttgart (DE); Mathias Schuler, Schwäbisch-Gmünd (DE); Dominik Baumüller, München (DE)

(73) Assignee: Werner Sobek Ingenieure GmbH, Stuttgart (DE)

( * ) Notice: Subject to any disclaimer, the term of this patent is extended or adjusted under 35 U.S.C. 154(b) by 378 days.

(21) Appl. No.: 09/646,101

(22) PCT Filed: Mar. 13, 1999

(86) PCT No.: PCT/EP99/01668

§ 371 (c)(1),
(2), (4) Date: Dec. 7, 2000

(87) PCT Pub. No.: WO99/48399

PCT Pub. Date: Sep. 30, 1999

(30) Foreign Application Priority Data

Mar. 21, 1998 (DE) ..... 198 12 553

(51) Int. Cl.[7] ..... A45B 19/10
(52) U.S. Cl. ..... 135/20.3; 135/33.2; 135/33.41; 135/43
(58) Field of Search ..... 135/19, 19.5, 20.2, 135/20.3, 33.2, 33.41, 43, DIG. 900; 446/201, 446/217, 241; 15/97.3, 53.2, DIG. 2

(56) References Cited

U.S. PATENT DOCUMENTS 2,736,329 A * 2/1956 Cornellier ..... 135/31
3,444,799 A 5/1969 Covington
3,683,441 A * 8/1972 Fromme ..... 15/97
3,765,726 A * 10/1973 Clark ..... 15/179
3,801,809 A * 4/1974 Slade ..... 240/2 R
4,084,600 A * 4/1978 dePolo ..... 135/20 R
5,020,557 A * 6/1991 Apple ..... 135/15.1
5,127,123 A * 7/1992 Belanger ..... 15/53.4
5,273,062 A * 12/1993 Mozdzanowski ..... 135/16
5,449,012 A 9/1995 Friedman
5,463,788 A * 11/1995 Ennis ..... 15/97.3
5,765,582 A * 6/1998 Molnar, IV ..... 135/16
5,784,841 A * 7/1998 Nowell ..... 52/220.5
5,813,077 A * 9/1998 Belanger et al. ..... 15/97.3
5,868,152 A * 2/1999 Brown ..... 135/31

FOREIGN PATENT DOCUMENTS

DE 62296 * 5/1892 ..... 135/19.5
EP 000628264 * 12/1994 ..... 135/20.3
FR 0581549 * 12/1924 ..... 135/25
FR 2247176 * 5/1975 ..... 135/20.2
WO WO 95/03724 2/1995

* cited by examiner

*Primary Examiner*—Lanna Mai
*Assistant Examiner*—Phi Dieu Tran A
(74) *Attorney, Agent, or Firm*—Bacon & Thomas

(57) ABSTRACT

An umbrella device which has a shank, an umbrella-like cap formed as a membrane and a driver. The membrane is connected to the shank and is caused by the driver to move from a position of rest where it droops limply around the shank to an open position where it is essentially horizontal due to the centrifugal forces of the membrane produced by the rotation of the membrane by the driver.

18 Claims, 12 Drawing Sheets

UMBRELLA DEVICE

FIELD OF THE INVENTION

The present invention relates to an umbrella device having a shank and an umbrella-like cap which can rotate around the shank and opened up.

BACKGROUND OF THE INVENTION

Umbrella devices in the form of umbrellas and parasols are known, whose umbrella-like cap is provided with ribs, one end of which is linked to a ring arranged at the upper end of a shank and the other end at a sleeve, which can be displaced and fixed in place along the shank for spreading the umbrella cap.

These ribs are required for supporting the cover material used as the covering. In case of umbrella devices of larger dimension, the ribs already constitute a large proportion of the dead weight of the umbrella device. With a filigreed weight-reducing design they are prone to buckling when strained by wind. The controlled folding up of the cover material and of the rod produces strain has been shown to be technically difficult with umbrella devices of large surface areas, and poses the danger of damage to the thin cover material of low flexural strength in the contact points between the cover and the ribs.

An umbrella device having a shank and an umbrella-like cap which can rotate around the shank and opened up is known, for example, from U.S. Pat. No. 5,020,557 and from European Patent No. EP-A 0 382 122. In the first case, the umbrella-like cap is rotatingly held for absorbing and compensating wind forces. In the second case, the umbrella-like cap has two elements arranged on top of each other, wherein the upper cap element can be manually rotated with respect to the lower, fixed-in-place cap element by preselected degrees of angle for filtering out undesirable sunlight components. Such umbrella devices with a manually rotatable cap are relatively expensive to produce and elaborate in use, since they can be opened up-only over provided ribs, which moreover have a considerable weight.

SUMMARY OF THE INVENTION

It is the object of the present invention to provide an umbrella device of the type mentioned at the outset which, while avoiding the above mentioned disadvantages, can be opened up and folded again in a simpler, and in particular automatic way.

According to the present invention, the umbrella-like cap can be motor driven and includes a membrane of low flexural strength, but with tensile strength. The membrane has a circular base surface which can be erected by means of centrifugal forces resulting from the rotation from a position of rest, where it droops limply around the shank to an opened, essentially horizontal position.

A light-weight umbrella device which can be automatically opened up is created by means of the steps in accordance with the present invention, which can be mechanically simplified and can be produced with a large area in particular. The umbrella device moreover provides an active ventilation of the space underneath the umbrella-like cap.

A preferred arrangement of the motor drive and of the holder of the membrane on the power take-off shaft results from fixing the shank at the head of the shank against relative rotation, and the use of an electric motor.

In a preferred manner, the motor drive can be realized either by means of an electric motor of small dimensions, a pneumatic or also a hydraulic drive mechanism. The energy supply for the motor drive is received in the shank for achieving a weather protection for it and/or to avoid spoiling the appearance. As an energy supply for a pneumatic drive mechanism, the shank itself can constitute the air-conducting tube.

The membrane can have a pagoda-shaped cut-out shape, matched to the specific influencing variables suitably employed for improving the aerodynamic stability of the umbrella device. For example, a shape of the cap can include ballast which can be useful.

Providing the membrane with radially and/or annularly arranged cords is also advantageous for improving the aerodynamic stability of the umbrella device. Favorable embodiments thereof ensue from a membrane provided with additional masses on the outer circumference of the membrane, such as a cord at the edge, individual weights, doubling of the membrane, or the like.

A further option for improving the aerodynamic stability and/or the unfolding process of the umbrella-like cap of the umbrella device results, from a membrane having a flat, pillow-like shape, which may be divided into radially and/or annularly arranged air chambers connected with a blower, or a pneumatic drive, from having the inside of the membrane, which is at rest, charged with compressed air, and from providing the shank with outlet openings in the area of the membrane when at rest.

Further details of the present invention can be taken from the description which follows, in which the present invention is described in greater detail and explained by means of the exemplary embodiments represented in the drawings.

BRIEF DESCRIPTION OF THE DRAWINGS

FIG. 1B, FIG. 11, illustrates still another embodiment of the present invention during the opening-up process in a schematic lateral view.

DESCRIPTION OF THE PREFERRED EMBODIMENTS

Figure 1A:
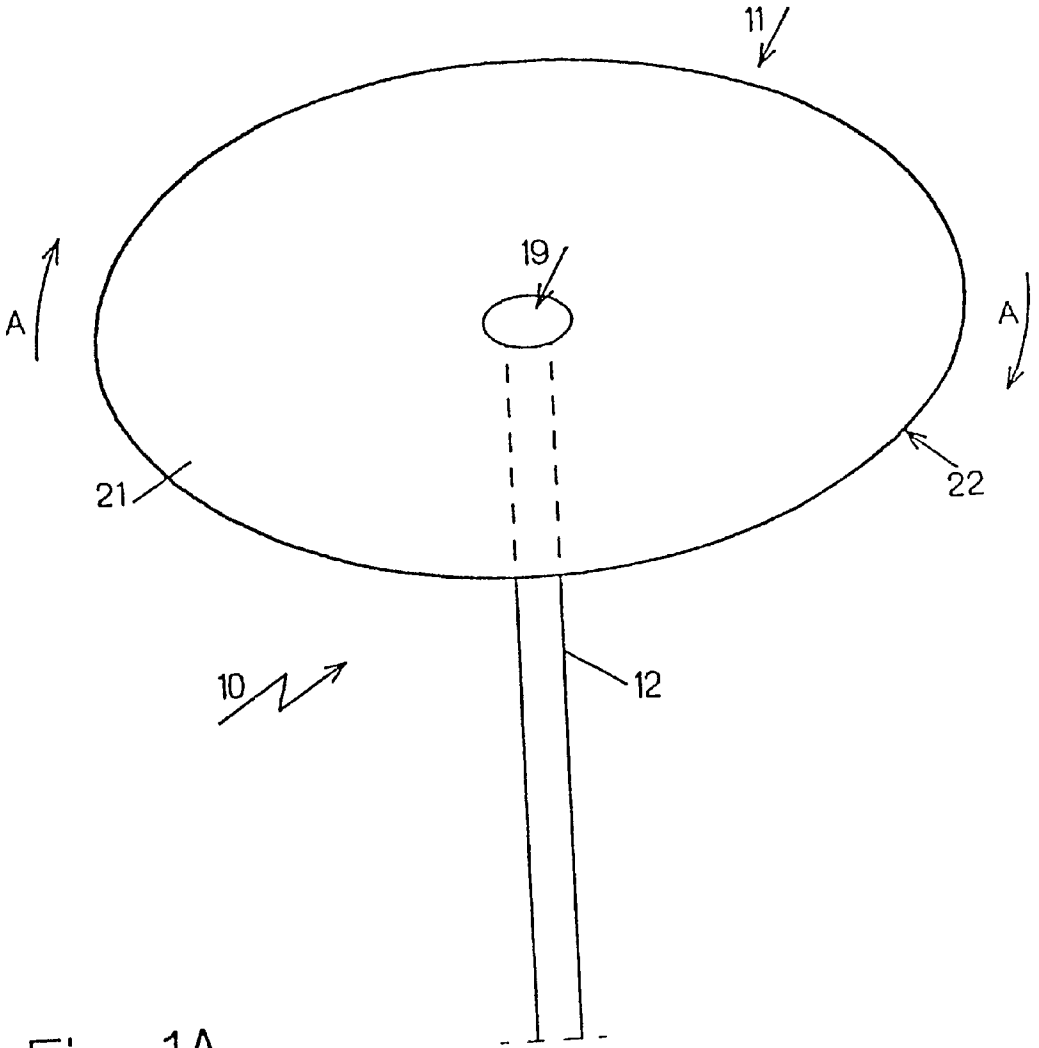
FIGS. 1A and 1B, illustrate an umbrella device in accordance with a preferred exemplary embodiment of the present invention in an opened-up operating position in a schematic perspective view or a schematic lateral view.

The umbrella device 10, 110 or 210 represented in the drawings has a ribless, umbrella-like cap 11, 111 or 211, which is rotatably maintained at the upper end of a shank 12, 112 or 212 and can be rotatably driven in such a way, that the umbrella-like cap 11 can be opened-up from a drooping, limp position of rest into an umbrella-like operating position, can be maintained opened up and stabilized by the centrifugal force resulting from its rotation.

Figure 1B:
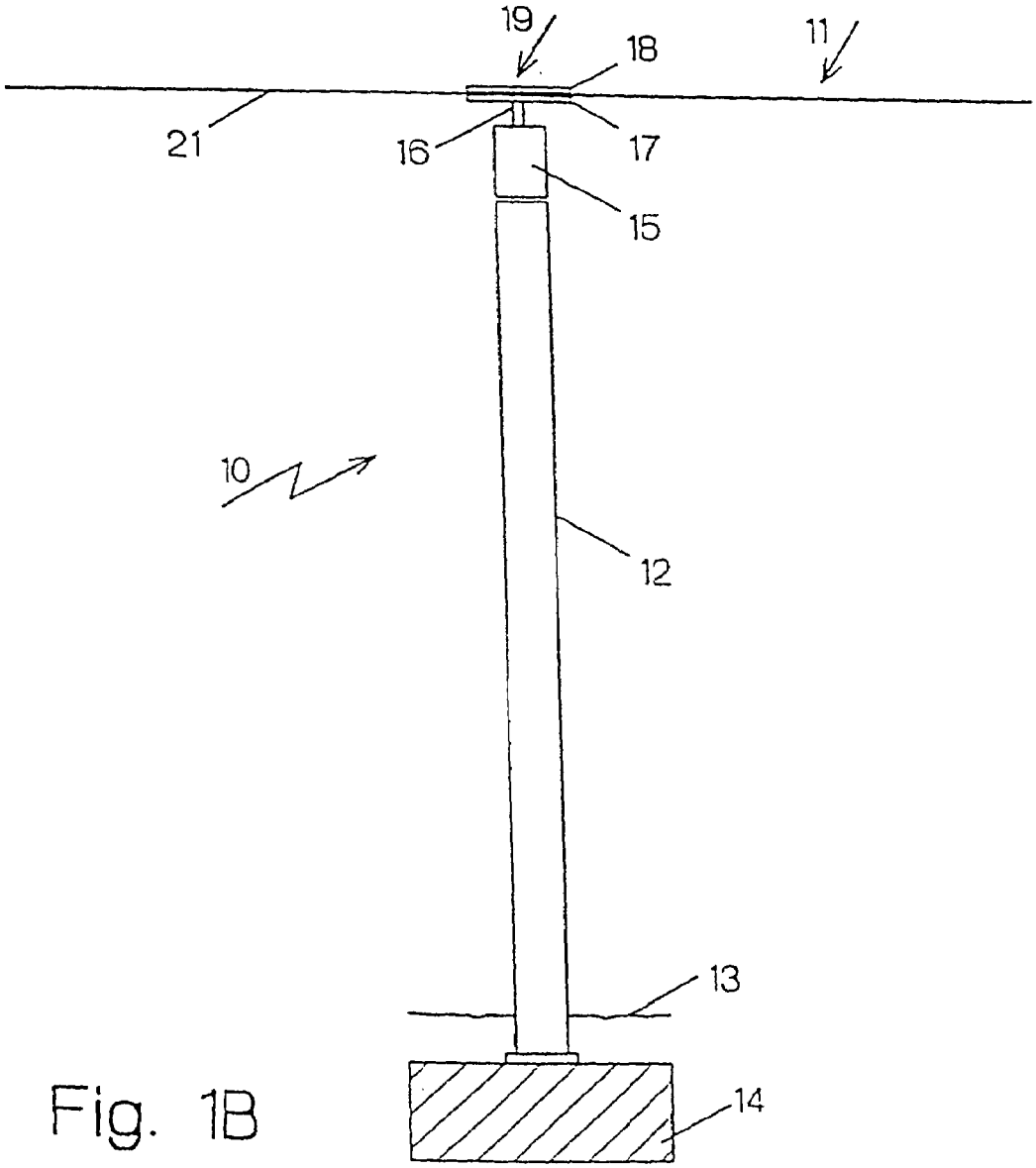

In accordance with FIG. 1B, the upwardly extending shank 12 is maintained fixed in place, for example fastened underneath the bottom-surface 13 on a block 14. A motor drive 15 is fastened or flanged at the upper end of the shank 12, whose vertically upwardly projecting drive shaft 16 is connected, fixed against relative rotation, with a lower disk 17 which, together with an oppositely located upper disk 18 is a part of a fastening device 19 for the cap 11.

The umbrella-like cap 11 essentially consists of a membrane 21 made of a light material of low flexural strength, but having tensile strength. The membrane 21 has a circular base surface and is fastened around its center between the two disks 17 and 18 of the fastening device 19, wherein the two disks 17 and 18 are typically arranged centered with respect to the circular peripheral edge 22 of the membrane 21. Maintaining the membrane 21 on the fastening device 19 can be provided in a manner not represented, for example by clamping the two disks 17, 18 against each other.

Figure 2:
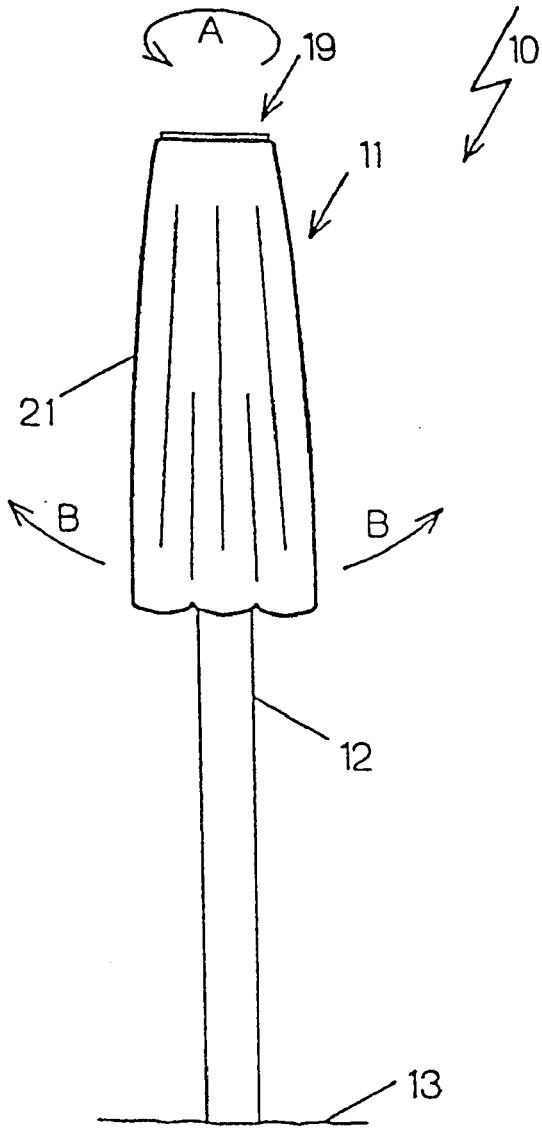
FIG. 2, illustrates the umbrella device in accordance with FIG. 1 in a schematic lateral view, but in the folded-up position of rest.

In the position of rest represented in FIG. 2, the membrane 21 is arranged around the shank 12, limply drooping down from the fastening device 19. It should be understood that the ratio between the membrane diameter and the shank length can be selected in accordance with conventional umbrellas or parasols. If the motor drive 15 which, in the exemplary embodiment represented here is an electric motor drive, is switched on, the membrane 21 is caused to rotate, for example in the direction A (FIG. 1A), because of which the membrane 21 is raised in the direction of the arrows B because of the centrifugal forces acting on it, until it has attained the opened-up, here approximately horizontal operating position, represented in FIGS. 1A and 1B. In this operating position, the rotation (arrows A) of the membrane 21 lasts as long as the umbrella-like cap 11 is intended to be kept opened up. The required size of the rotating speed is a function of various factors, such as weight, exterior effects, and the diameter of the membrane 21, as well as the amount of the possible additional ballasting. To fold the membrane 21 into the position of rest or parked position in accordance with FIG. 2, the motor drive 15 is switched off or the speed of rotation is steadily reduced.

Figure 3:
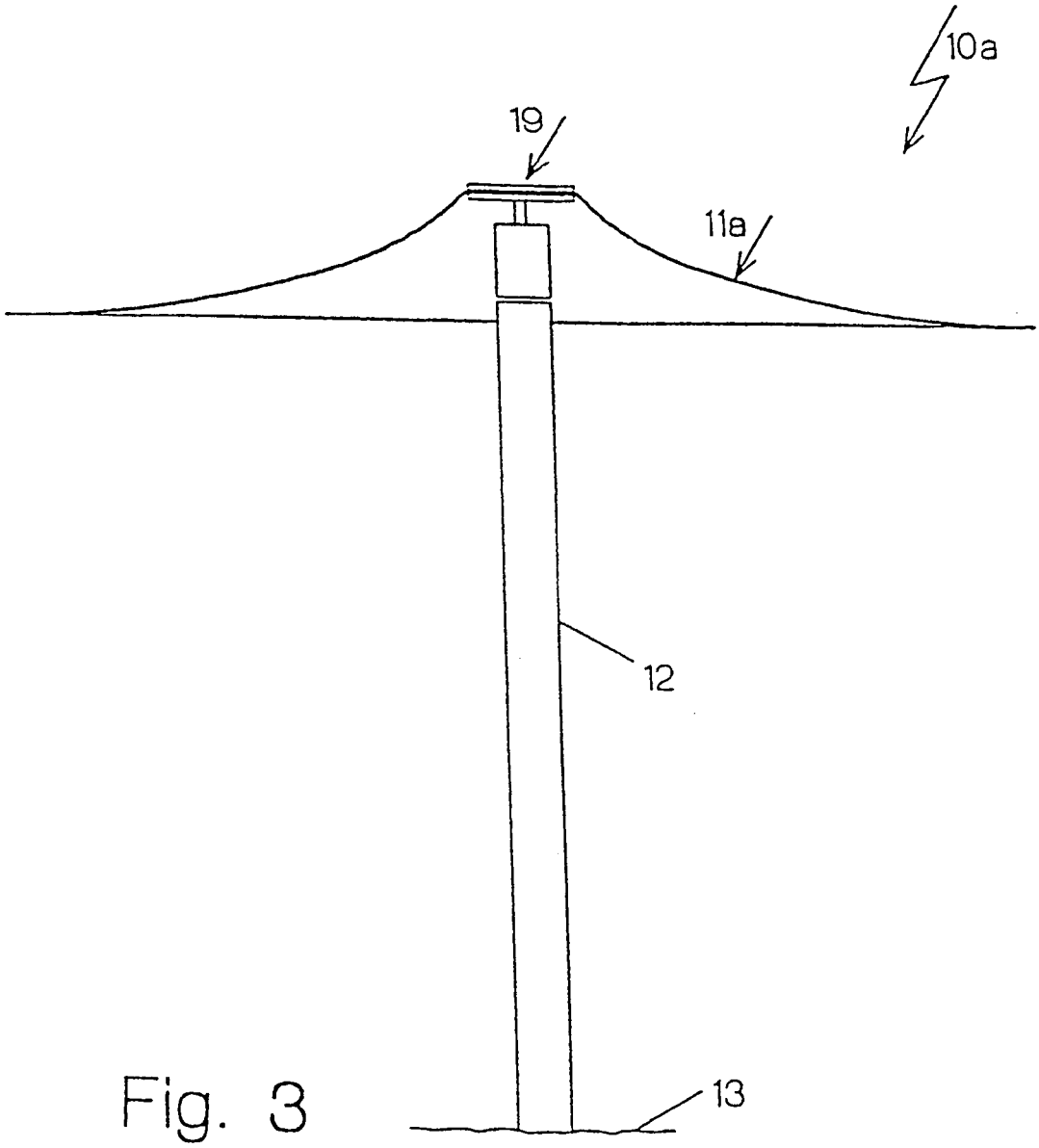
FIG. 3, illustrates a representation corresponding to FIG. 1B, but in accordance with a second embodiment of the present invention, FIGS. 4A, B to 8A, B, illustrates representations corresponding to FIG. 1A, or partial enlargements in accordance with the circles IV to VIII, but in accordance with further exemplary embodiments of the present invention.
Figure 4:
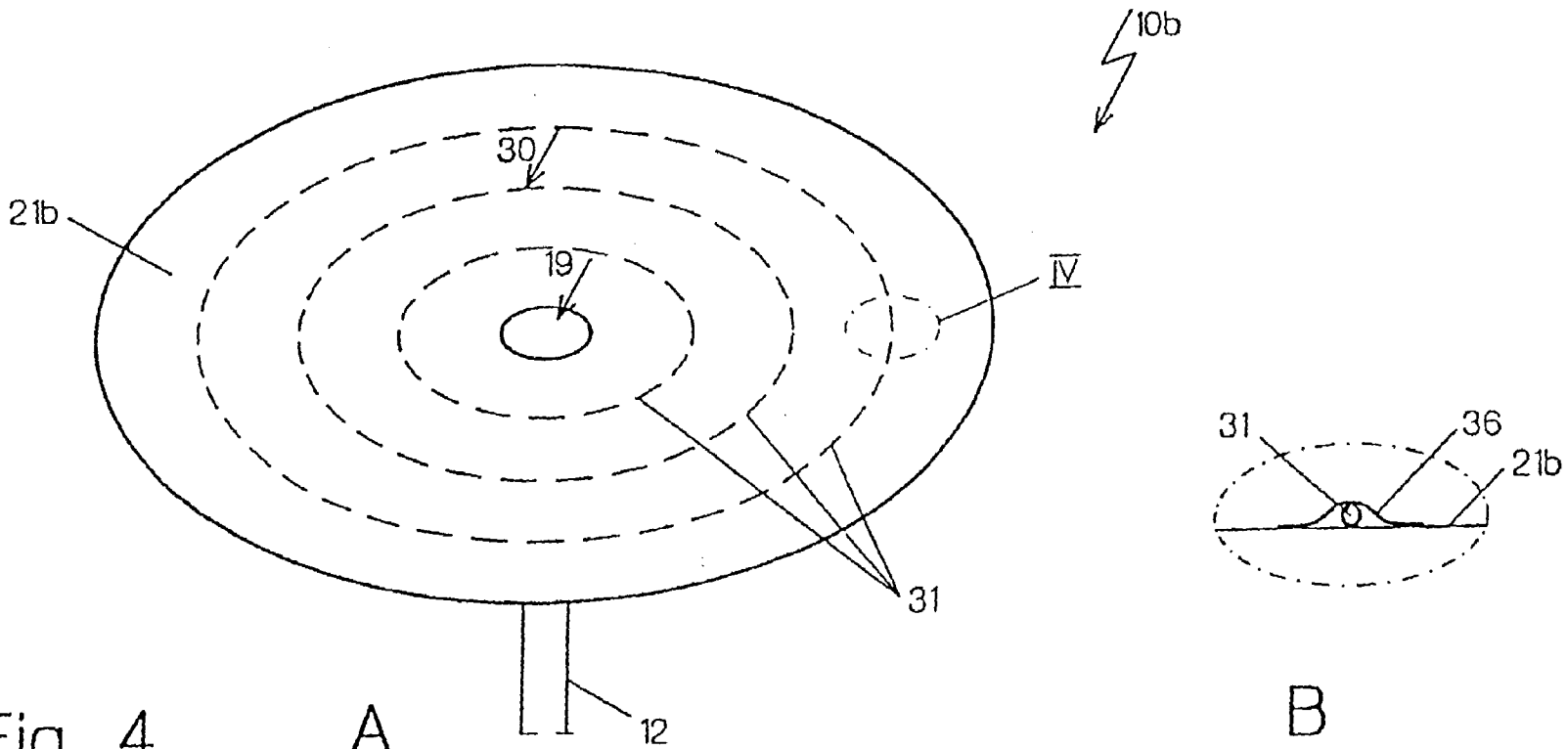

The embodiment in accordance with FIG. 3 shows an umbrella device 10*a* with a pagoda-shaped cut-out shape of the umbrella cap 11*a* matched to the specific influencing variables.

FIGS. 4 to 8 show embodiments of umbrella devices 10*b* to 10*f*, whose umbrella-like caps 11*b* to 11*f* or membranes 21*b* to 21*f* are equipped with ballasting 30 of different kinds. In accordance with FIG. 4, the membrane 21*b* is provided with annular cords 31 which, in accordance with FIG. 4B are covered and held by a strip 36 made, for example, from the material of the membrane.

Figure 5:
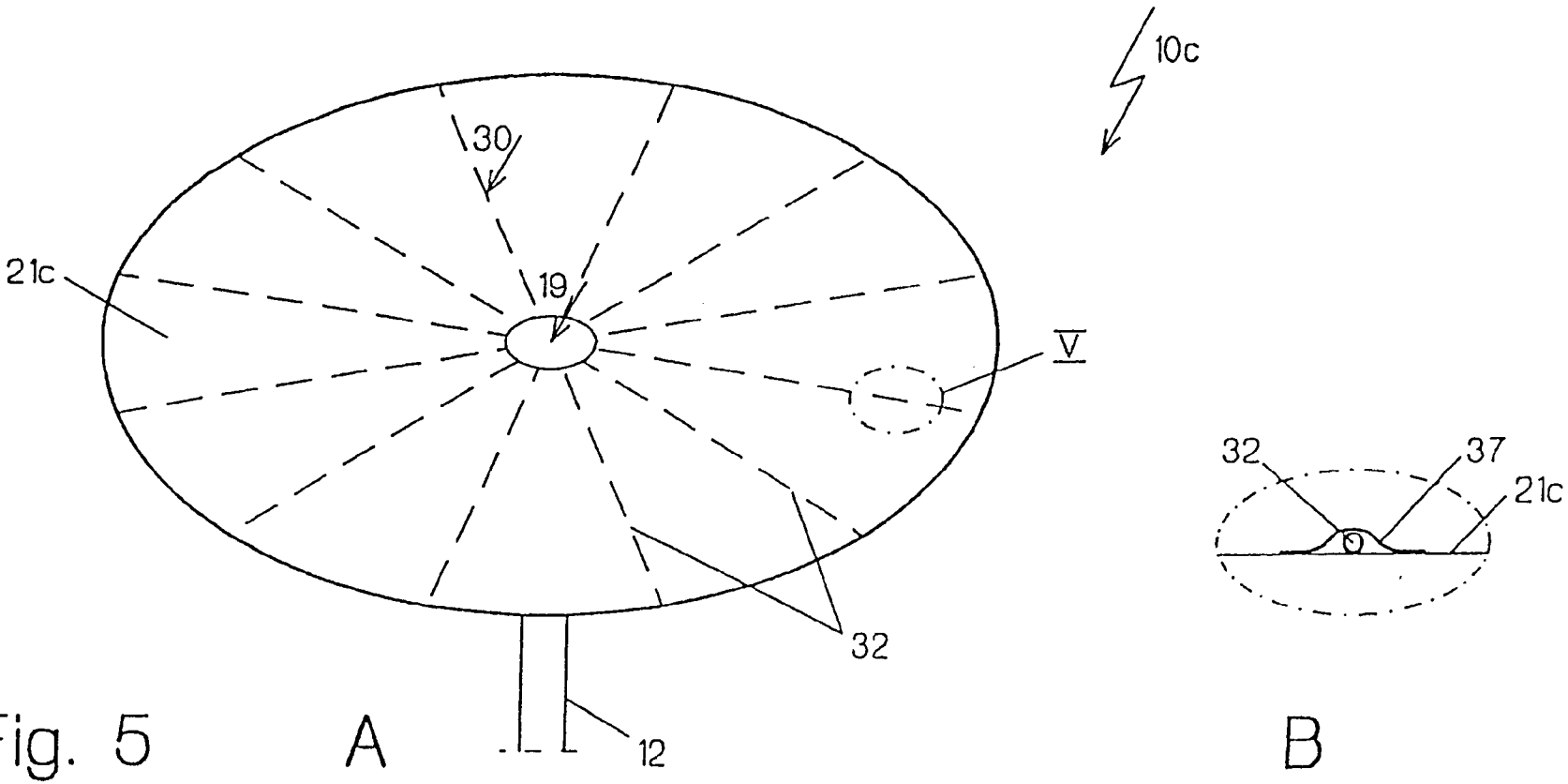

FIG. 5 shows ballasting 30 in the form of radial cords 32, which are maintained on the top or the underside of the membrane 21*c*, for example also by means of strips 37.

Figure 6:
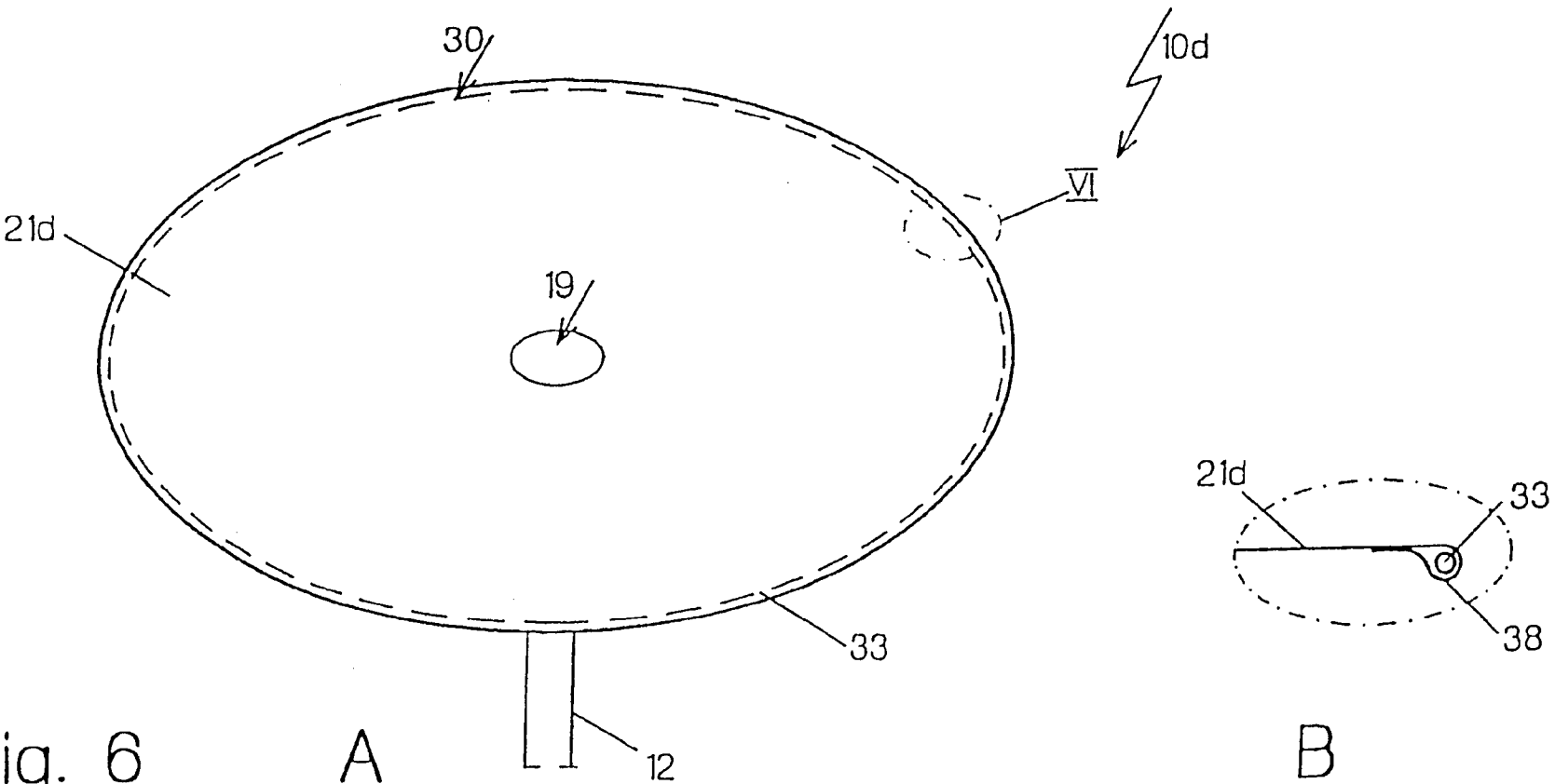

FIG. 6 shows an edge cord 33 as ballasting, which is held in an edge seam 38 of the membrane 21*d*.

Figure 7A:
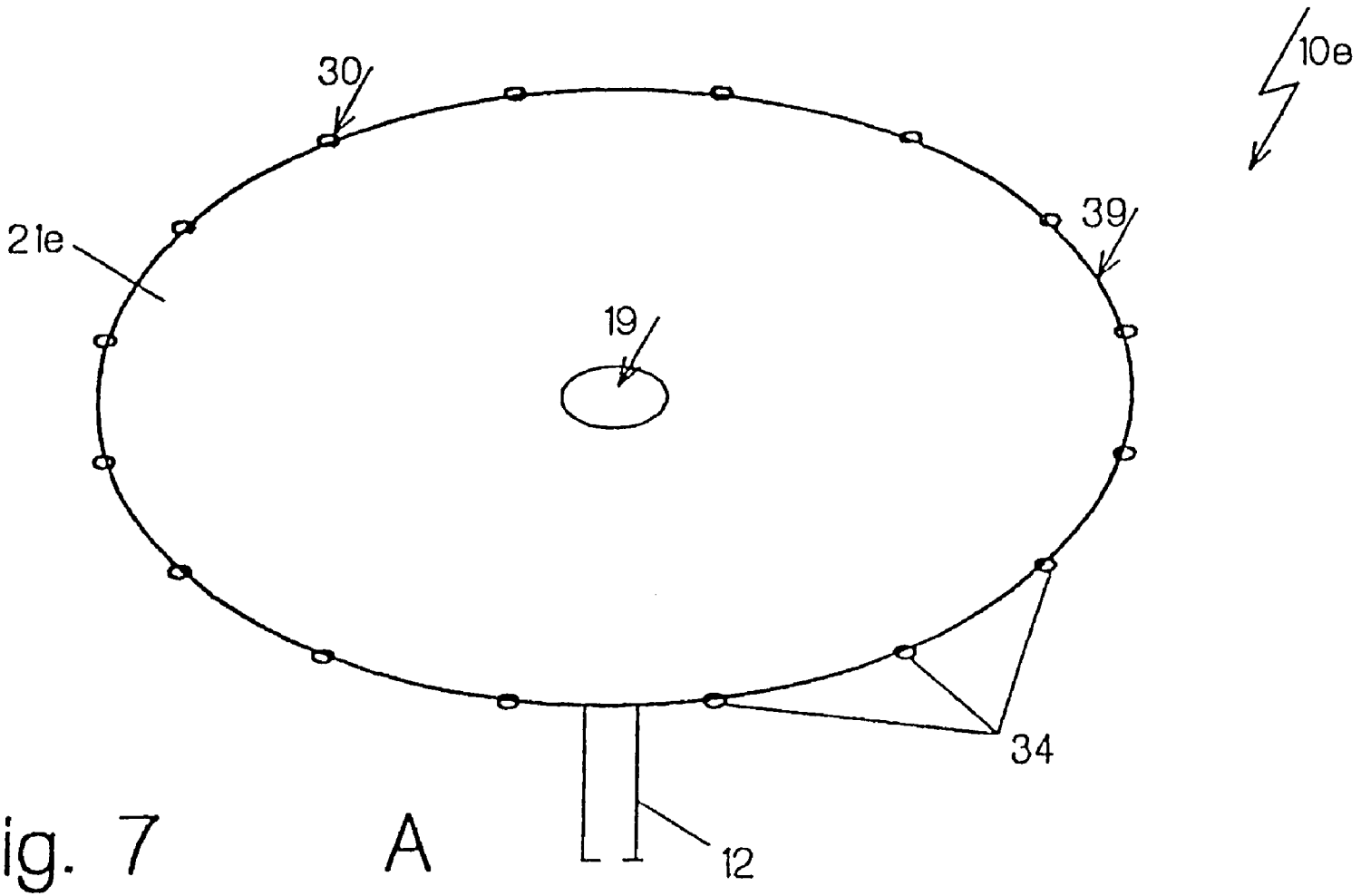

In the embodiment in FIG. 7, the ballasting 30 is formed by individual masses 34, which are fastened in an evenly distributed arrangement on the outer edge 29 of the membrane 21*e*.

Figure 8:
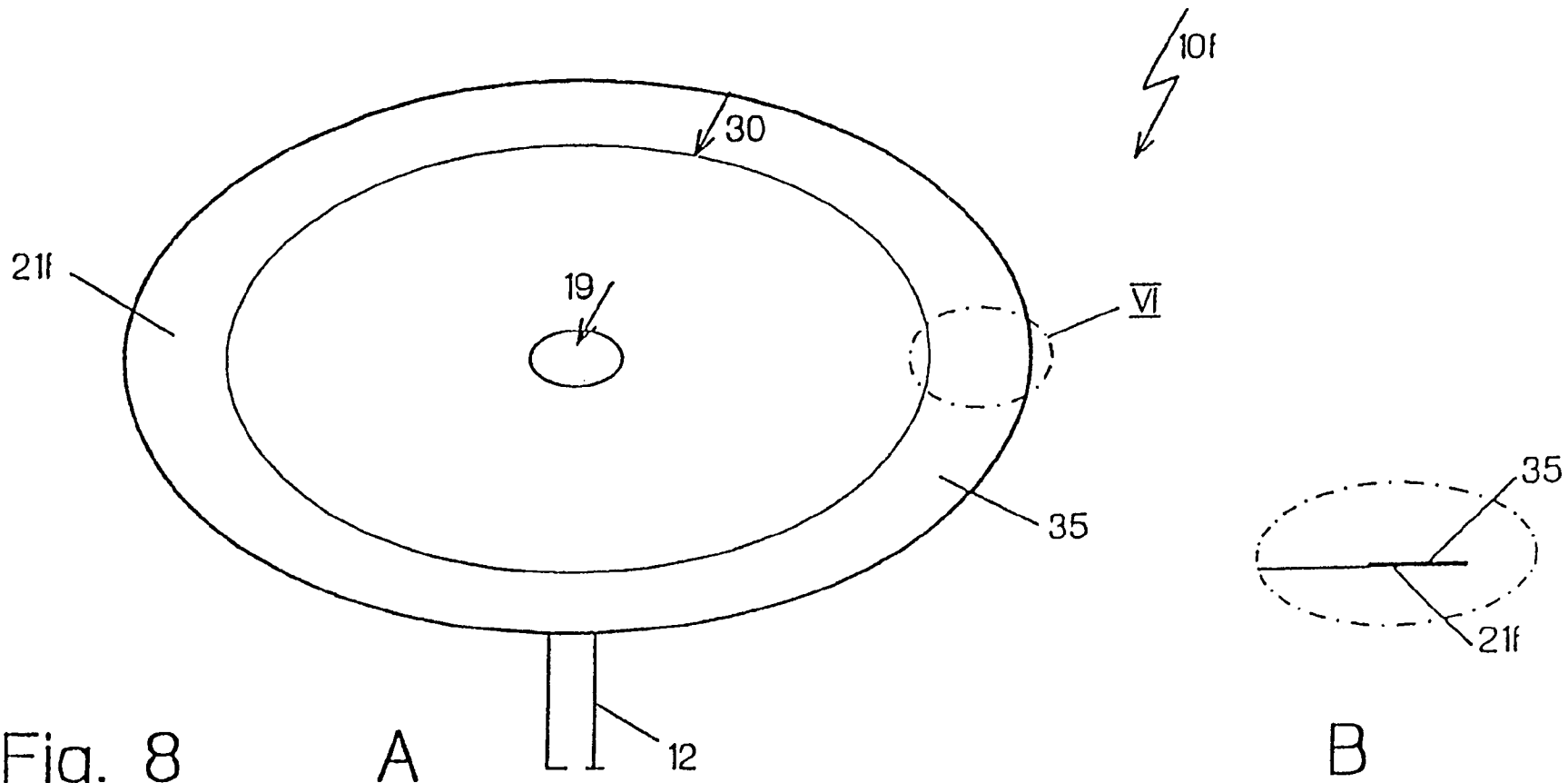

Finally, FIG. 8 shows ballasting 30 at the peripheral edge, for example by means of an annular doubling 35 of the material of the membrane 21*f*.

An improvement of the aerodynamic stability and the opening process when the rotating process is started results from the ballasting.

Figure 9:
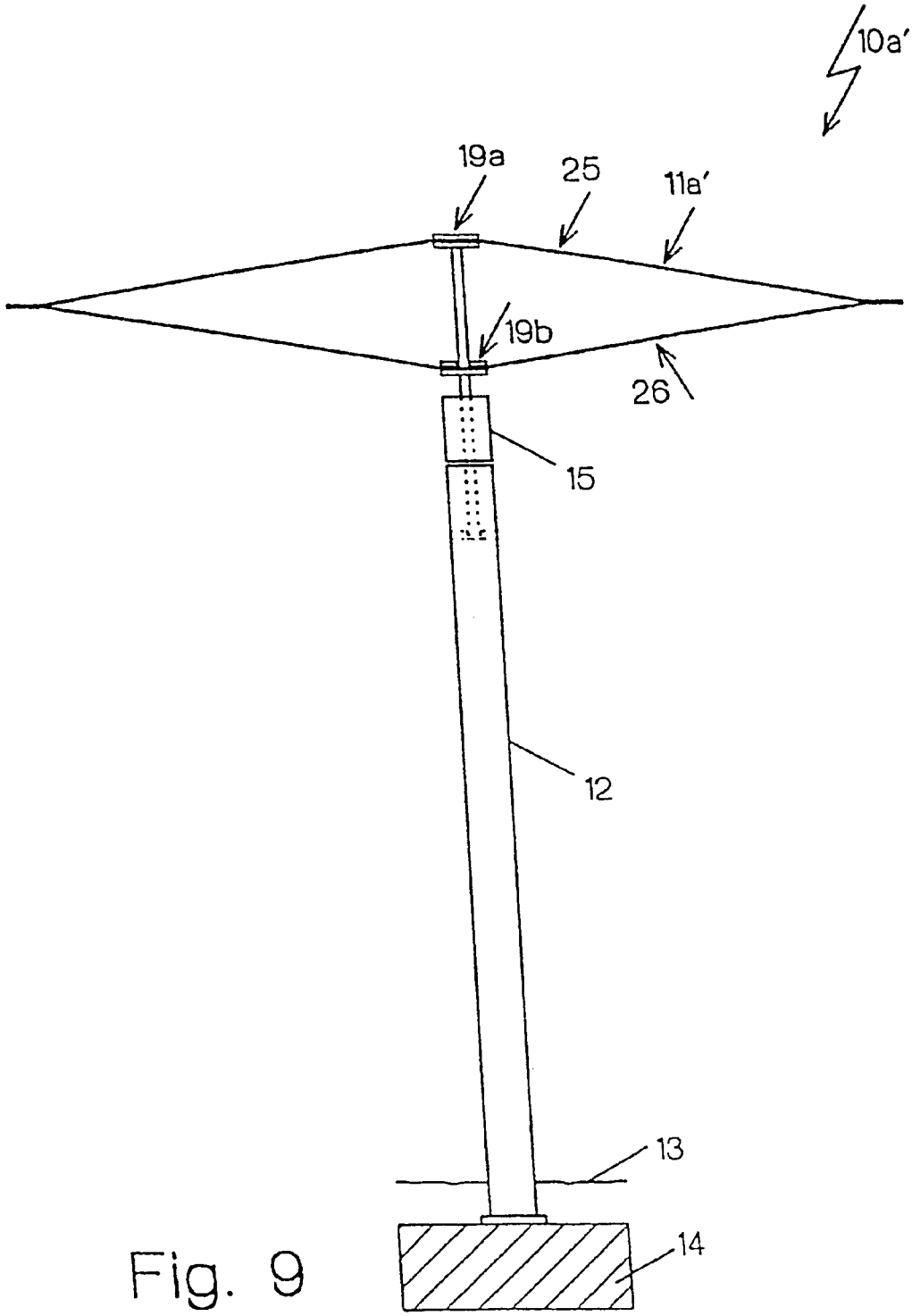
FIG. 9, illustrates a representation of a further embodiment corresponding to FIG. 1B, FIG. 10, illustrates a representation of a further embodiment corresponding

The embodiment in accordance with FIG. 9 shows an umbrella device 10*a*' with a double-layered cap 11*a*', whose upper, 25, and lower layer 26 are each maintained at an upper, 19*a*, and lower fastening device 19*b*.

Figure 10:
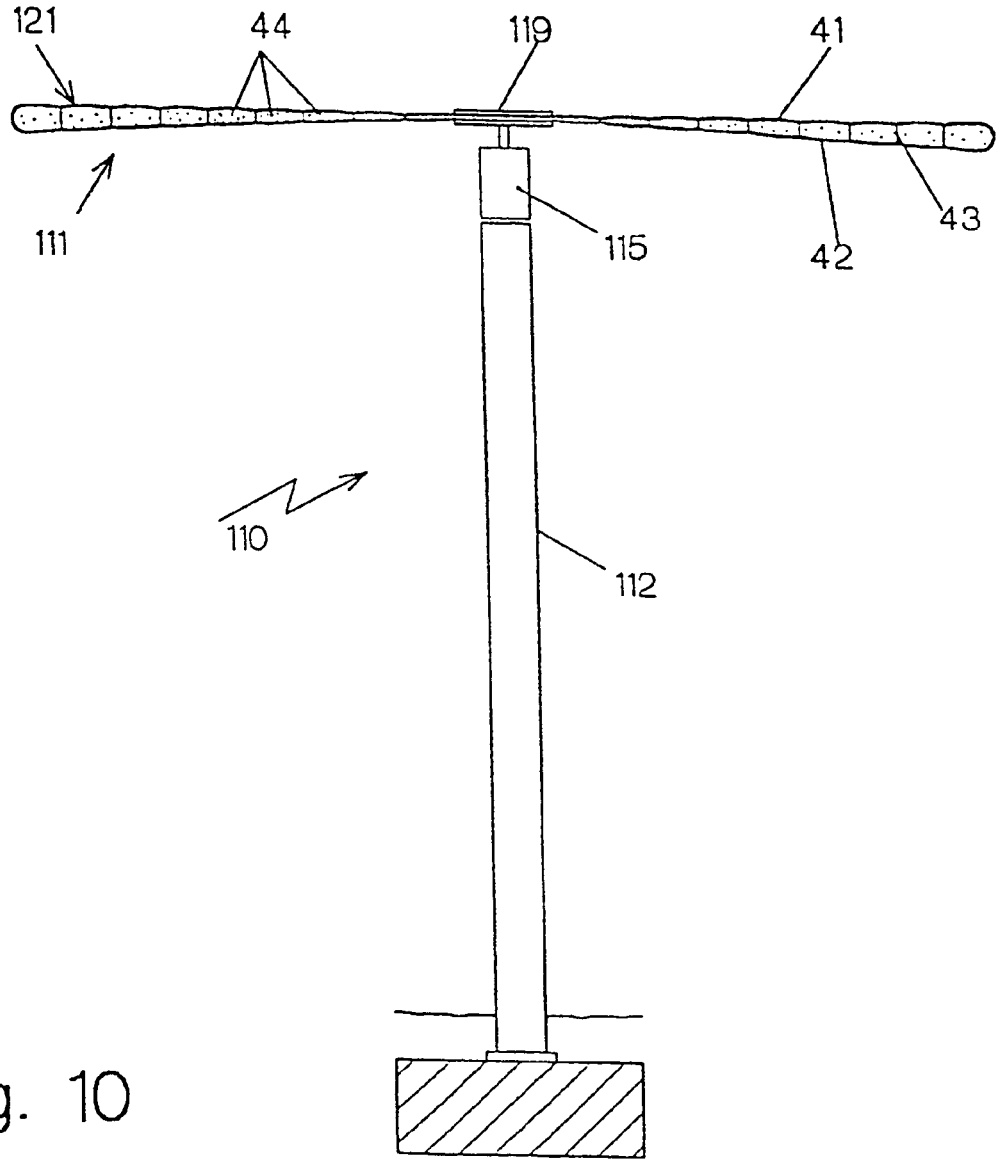

The umbrella device 110 represented in FIG. 10 has a cap 111, wherein the membrane 121 is embodied as a flat cushion with an upper membrane layer 41 and a lower membrane layer 42, which are connected along the outer edge. The two membrane layers 41 and 42 are divided into individual chambers 44 by means of intermediate walls 43. In the exemplary embodiment, the radial and/or ring-shaped chambers 44 are filled with air, wherein the interior pressure to be built up in the chambers 44 can be provided in different ways during start-up and during rotation in the operating position. For this purpose, the membrane 121 or its chambers 44 are connected in a manner not represented with a blower. The interior pressure built up in the chambers 44 can also be temporarily limited in the operating phase. It is for example possible to increase the interior pressure during the duration of external effects, such as increased wind strain, and to reduce it during phases of reduced effects, or even to evacuate the chambers 44.

Figure 11:
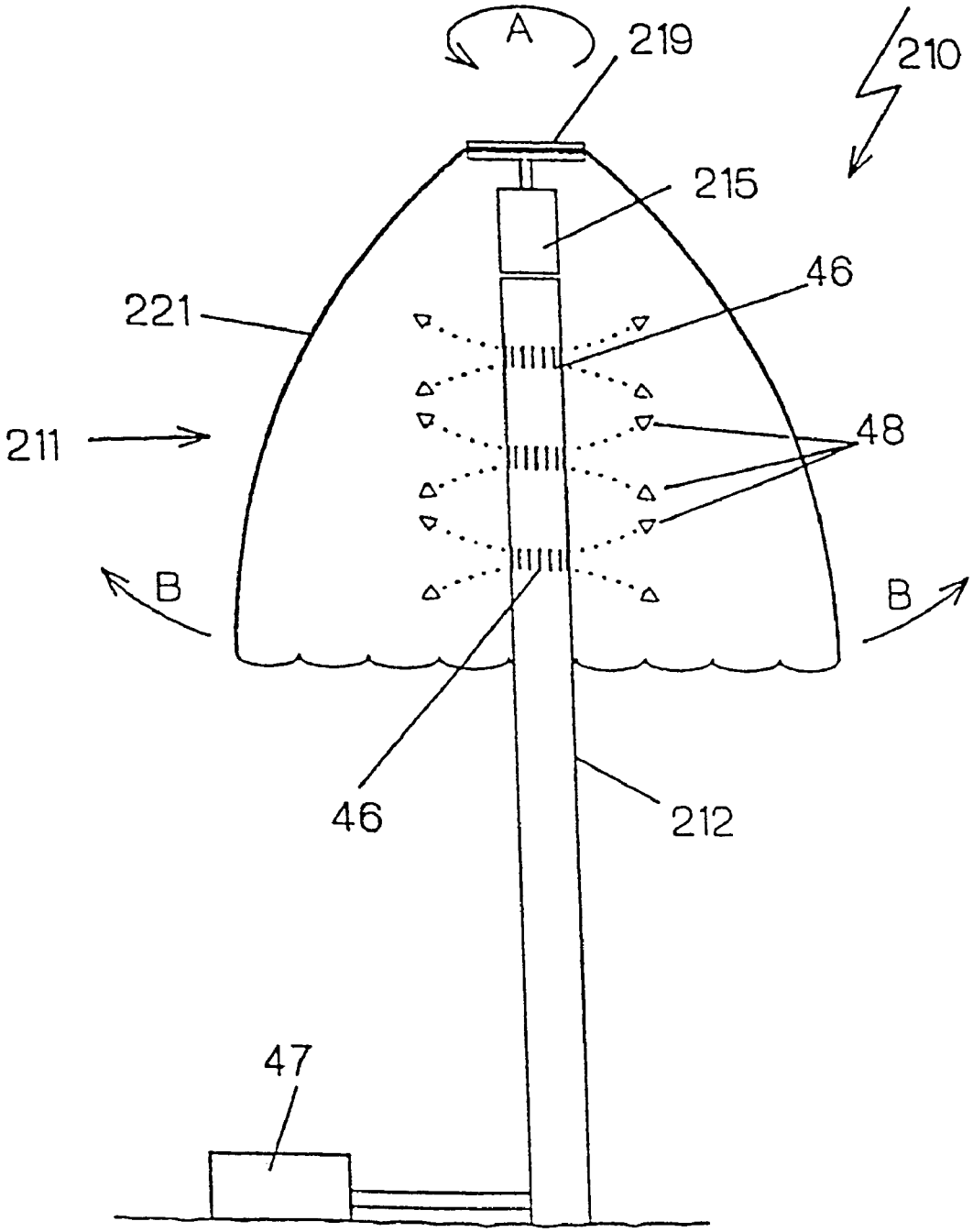

In the umbrella device 210 represented in FIG. 11, the shank 212 is provided with outlet openings 46 in its upper area covered by the membrane 212 in the position of rest, which are arranged in the wall of the hollow shank 212, for example distributed over the circumference and at several heights. The hollow shank 212 is connected with a blower 47. The compressed air generated by the blower 47 is conducted through the hollow shank 212 and can exit through the outlet openings 46. It is possible by means of this compressed air flow 48 to effectively aid the opening process of the membrane 221, which here has the shape of the membrane 21 in accordance with FIGS. 1 and 2, during the rotation of the membrane 221 (arrow A). After having attained the operating position of the membrane 221, the blower 47 can be switched off.

While the motor drive 15 is represented as an electric motor in the exemplary embodiments shown in the drawings, whose electrical feed line can be conducted through the hollow shank 12, 112, 212, it is provided in accordance with an embodiment not represented to design the motor drive 15 as a pneumatic drive. It is possible to use the blower 47 in accordance with FIG. 10 for this, in which the underside of the fastening device 19 is embodied in the form of a wind wheel, for example. With this arrangement the outlet openings 46 are designed to be closable. It should be understood that such a pneumatic drive mechanism can also be advantageous in connection with the exemplary embodiment in FIG. 10.

What is claimed is:

1. An umbrella device, comprising:

a shank;

an umbrella-like cap connected to said shank, said umbrella-like cap comprising a membrane having tensile strength and low flexural strength, and a circular base surface; and driving means for driving said membrane, wherein said membrane defining a position of rest, wherein it droops limply around said shank, and an opened position, wherein it assumes an essentially horizontal position, said membrane assuming said opened position under the influence of centrifugal force generated due to the rotation of said membrane by said driving means.

2. The umbrella device in accordance with claim 1, wherein said driving means comprises an electric motor.

3. The umbrella device in accordance with claim 1, wherein said shank defines a head and said driving means is located at the head of said shank, and wherein said shank is fixed against relative rotation.

4. The umbrella device in accordance with claim 3, wherein said driving means comprises an electric motor.

5. The umbrella device in accordance with claim 1, further comprising:

means for clamping said membrane to said shank, said means for clamping comprising two disks fixed against relative rotation with respect to said driving means.

6. The umbrella device in accordance with claim 1, wherein said driving means comprises a pneumatic drive.

7. The umbrella device in accordance with claim 1, wherein the energy supply for said driving means is received in said shank.

8. The umbrella device in accordance with claim 1, wherein said membrane has a pagoda-shaped cut-out shape, matched to specific influencing variables.

9. The umbrella device in accordance with claim 1, further comprising:

ballasting, and wherein said membrane is provided with said ballasting.

10. The umbrella device in accordance with claim 9, wherein said membrane is provided with one of: radially, annularly, and radially and annularly arranged cords as said ballasting.

11. The umbrella device in accordance with claim 9, wherein said membrane is provided with additional masses as ballasting on its outer circumference in accordance with one of a cord at the edge, individual weights, and doubling of said membrane.

12. The umbrella device in accordance with claim 1, wherein said membrane has a double-layered shape in cross section.

13. The umbrella device in accordance with claim 1, wherein said membrane has a flat, pillow-like shape.

14. The umbrella device in accordance with claim 13, wherein said pillow-like membrane is divided into one of: radially, annularly, and radially and annularly arranged air chambers.

15. The umbrella device in accordance with claim 14, further comprising:

a blower, and wherein said air chambers are connected with said blower.

16. The umbrella device in accordance with claim 15, wherein said air chambers are connected with said driving means, and wherein said driving means comprises a pneumatic device.

17. The umbrella device in accordance with claim 1, wherein in the rest position said membrane can be charged with compressed air.

18. The umbrella device in accordance with claim 1, wherein said shank has air outlet openings located in the area of said membrane which is in the rest position.

* * * * *